US005575322A

United States Patent [19]

Miller

[11] Patent Number: 5,575,322

[45] Date of Patent: Nov. 19, 1996

[54] ROLLING PROTECTIVE SHUTTERS

[76] Inventor: James V. Miller, 893 N. Maryknoll Cir., Glen Ellyn, Ill. 60137

[21] Appl. No.: 529,219

[22] Filed: Sep. 15, 1995

[51] Int. Cl.[6] ..... E06B 9/08

[52] U.S. Cl. ..... 160/133; 160/183

[58] Field of Search ..... 160/133, 183, 160/23.1, 270, 271, 272, 273.1, 32, 35, 36, 41, 84.06, 172 R, 236, 232, 235

[56] References Cited

U.S. PATENT DOCUMENTS

| | | | |
|---|---|---|---|
| 638,314 | 12/1899 | Blades . | |
| 845,526 | 2/1907 | Collins . | |
| 876,593 | 1/1908 | Rush . | |
| 1,579,839 | 4/1926 | Raper . | |
| 3,431,964 | 3/1969 | Rogers | 160/23 |
| 4,037,639 | 7/1977 | Jones | 160/133 |
| 4,294,302 | 10/1981 | Ricke | 160/133 |
| 4,345,635 | 8/1982 | Solomon | 160/133 |
| 4,519,434 | 5/1985 | Forquer | 160/133 |
| 4,807,687 | 2/1989 | Finch et al. | 160/133 |
| 4,930,563 | 6/1990 | Finch et al. | 160/271 |
| 5,070,925 | 12/1991 | Paule | 160/23.1 X |
| 5,209,281 | 5/1993 | Kraeutler | 160/84.06 |
| 5,365,990 | 11/1994 | Ueda | 160/23.1 |
| 5,426,893 | 6/1995 | Hoffman | 49/464 |
| 5,469,905 | 11/1995 | McKinney et al. | 160/183 X |

OTHER PUBLICATIONS

Sweet's General Building & Renovation 1993 Catalog File, Enviroblind Exterior Rolling Shutters, Environmental Seal and Security Co., Inc. #B489, 4 pages.

Sweet's General Building & Renovation 1993 Catalog File, Hurst Shutters Accordian Shutters/Removable Shutters, Hurst Awning Company, Inc. #B492, 8 pages.

Sweet's General Building & Renovation 1993 Catalog File, Rolladen Rollshutters, Rolladen Inc., #B499, 8 pages.

Sweet's General Building & Renovation 1993 Catalog File, Rollaway Insulating Security Shutters, Roll-A-Way, #B500, 8 pages.

Sweet's General Building & Renovation 1993 Catalog File, Solaroll, Solaroll Shade & Shutter Corporation, Catalog 561, #B505, 44 pages.

Sweet's General Building & Renovation 1993 Catalog File, "Custom Designed" Roll-A-Flex Rolling Shutter protection system, Folding Shutter Corporation, #B507, 4 pages.

Sweet's General Building & Renovation 1993 Catalog File, Willard Island Shutter Brochure, Willard Shutter Company, Inc., #B515, 12 pages.

SIRO Safety Roller Blind brochure, 4 pages—prior art.

SIRO Aluminum Roller Grate LM72 brochure, 4 pages—prior art.

LAKAL Rolladensysteme, LAKAL Profil AHS 75 brochure, 4 pages—prior art.

*Primary Examiner*—David M. Purol

*Attorney, Agent, or Firm*—Marshall, O'Toole, Gerstein, Murray & Borun

[57] ABSTRACT

A rolling shutter assembly having a shutter support member and a shutter coupled to the shutter support member. The shutter has a plurality of individual slats and a plurality of hinges interconnecting the slats. Each of the slats has a pair of end portions, and the slats include a first set of slats and a second set of slats, each of the slats in the first and second sets being alternated so that each of the hinges is connected to one of the slats in the first set and one of the slats in the second set. The shutter assembly has a pair of shutter tracks and an arrangement for rolling the shutter from an extended position in which the end portions of the slats are disposed in the shutter tracks to a retracted position in which the shutter is rolled up on the shutter support member. The hinges and the shutter tracks are adapted to facilitate, when the shutter is in the extended position, the slats in the first set of slats to occupy a first relative position and the slats in the second set of slats to occupy a second relative position.

28 Claims, 7 Drawing Sheets

ROLLING PROTECTIVE SHUTTERS

BACKGROUND OF THE INVENTION

The present invention is directed to a rolling protective shutter assembly which has a protective shutter, for covering a window or door opening, that may be rolled up into a shutter housing when not in use.

Rolling protective shutters are conventional and are used to provide protection against extreme weather conditions and to deter theft, for example. One such rolling protective shutter is disclosed in U.S. Pat. No. 4,345,635 to Solomon. As shown in FIGS. 1 and 2 of that patent, the Solomon shutter is composed of a plurality of elongate slats, each of which has a pair of circular ribs attached to its sides. The slats are interconnected by a plurality of elongate hinges, each of which has a pair of circular apertures in which the circular ribs of the slats are disposed. When the Solomon shutter is unrolled to its protective position, each of the slats in the shutter is disposed vertically. When not in use, the Solomon shutter may be rolled up into a housing disposed at the upper end of the protective shutter.

Although the Solomon protective shutter is specifically designed as a security closure for a store front, rolling protective shutters are also used to protect against extreme weather conditions, such as hurricanes. For that use, protective shutters are tested to determine their ability to withstand the extreme conditions caused by a storm. For example, such tests may include an impact test in which a wooden 2-by-4 is propelled at the shutter being tested at a speed of 35 miles per hour. A shutter that does not prevent the 2-by-4 from passing through it would fail the impact test.

It is highly advantageous that protective shutters be designed to pass such testing. To strengthen a flat shutter in which all of the slats are vertically disposed, such as the Solomon shutter, vertical reinforcing members periodically spaced along the width of the shutter have been utilized. However, such reinforcing members add to the cost of the shutter.

An alternative shutter design that has been used to provide additional strength is a rigid, unitary panel having horizontally disposed corrugations. Although the corrugations of the rigid panel give added strength, the panel design is undesirable since it is not capable of being rolled up. Unitary panels present a storage problem since they must be stored somewhere when not in use, and it is burdensome and impractical to use unitary panels to provide storm protection for windows above the ground floor of a building since the panels must somehow be secured, with the use of a ladder for example, to the outside of the windows.

SUMMARY OF THE INVENTION

In one aspect, the invention is directed to a rolling shutter assembly having a shutter formed of a plurality of individual slats. When unrolled, the individual slats of the shutter assembly occupy different orientations relative to each other to give added strength to the shutter, without compromising its ability to be rolled up.

The rolling shutter assembly has a shutter support member, a shutter coupled to the shutter support member, and a pair of shutter tracks. The shutter is formed of a plurality of individual slats and a plurality of hinges interconnecting the slats. The shutter assembly has means for rolling the shutter from an extended position in which portions of the slats are disposed in the shutter tracks to a retracted position in which the shutter is rolled up on the shutter support member. The hinges and the shutter tracks are adapted to facilitate the slats to occupy different relative orientations when the shutter is in the extended position.

The slats may be composed of a first set of slats and a second set of slats, each of the slats in the first and second sets being alternated so that each of the hinges is connected to one of the slats in the first set and one of the slats in the second set. The hinges and the shutter tracks may include means for facilitating the first and second sets of slats to occupy different relative orientations when the shutter is in its extended position.

In a first embodiment, when the shutter is in the extended position, each slat in the first set occupies an angled orientation aligned with a direction between about 10° and about 80° with respect to a horizontal axis, and each slat in the second set occupies an angled orientation aligned with a direction between about 100° and about 170° with respect to the horizontal axis. In a second embodiment, when the shutter is in the extended position, each slat in the first set occupies a substantially horizontal orientation and each slat in the second set occupies a substantially vertical orientation. In a third embodiment, when the shutter is in the extended position, each slat in the first set occupies a substantially horizontal orientation and each slat in the second set occupies an angled orientation aligned with a direction between about 10° and about 170° with respect to a horizontal axis.

Each of the shutter tracks of the shutter assembly may have a pair of side walls between which portions of the slats are disposed, and the side walls are spaced apart by a distance of at least twice the maximum thickness of the shutter to allow the slats to occupy their different relative orientations.

The shutter assembly may be provided with a pair of retaining walls, and the ends of the slats may be provided with locking members, such as tabs, the retaining walls being spaced apart by a distance less than the width of the locking members so that the locking members are retained in the shutter tracks when the shutter is in the extended position.

In another aspect, the invention is directed to a rolling shutter assembly having a shutter support member, a shutter coupled to the shutter support member and comprising a plurality of slats and a plurality of hinges interconnecting the slats, with the slats being formed from a single sheet of material, such as plastic. The shutter assembly has a pair of shutter tracks and means for rolling the shutter from an extended position in which the slat portions are disposed in the shutter tracks to a retracted position in which the shutter is rolled up on the shutter support member, and the hinges and the shutter tracks are adapted to facilitate the slats to occupy different relative orientations when the shutter is in its extended position. The width occupied by the slats when the shutter is in the extended position is substantially greater than the radial thickness of the shutter when it is rolled up on the shutter support member. Each of the hinges of the shutter assembly may be composed of an elongate V-shaped slot formed in the sheet of material.

The features and advantages of the invention will be apparent to those of ordinary skill in the art in view of the detailed description of the preferred embodiments, which is made with reference to the drawings, a brief description of which is provided below.

DETAILED DESCRIPTION OF THE PREFERRED EMBODIMENTS

Figure 1:
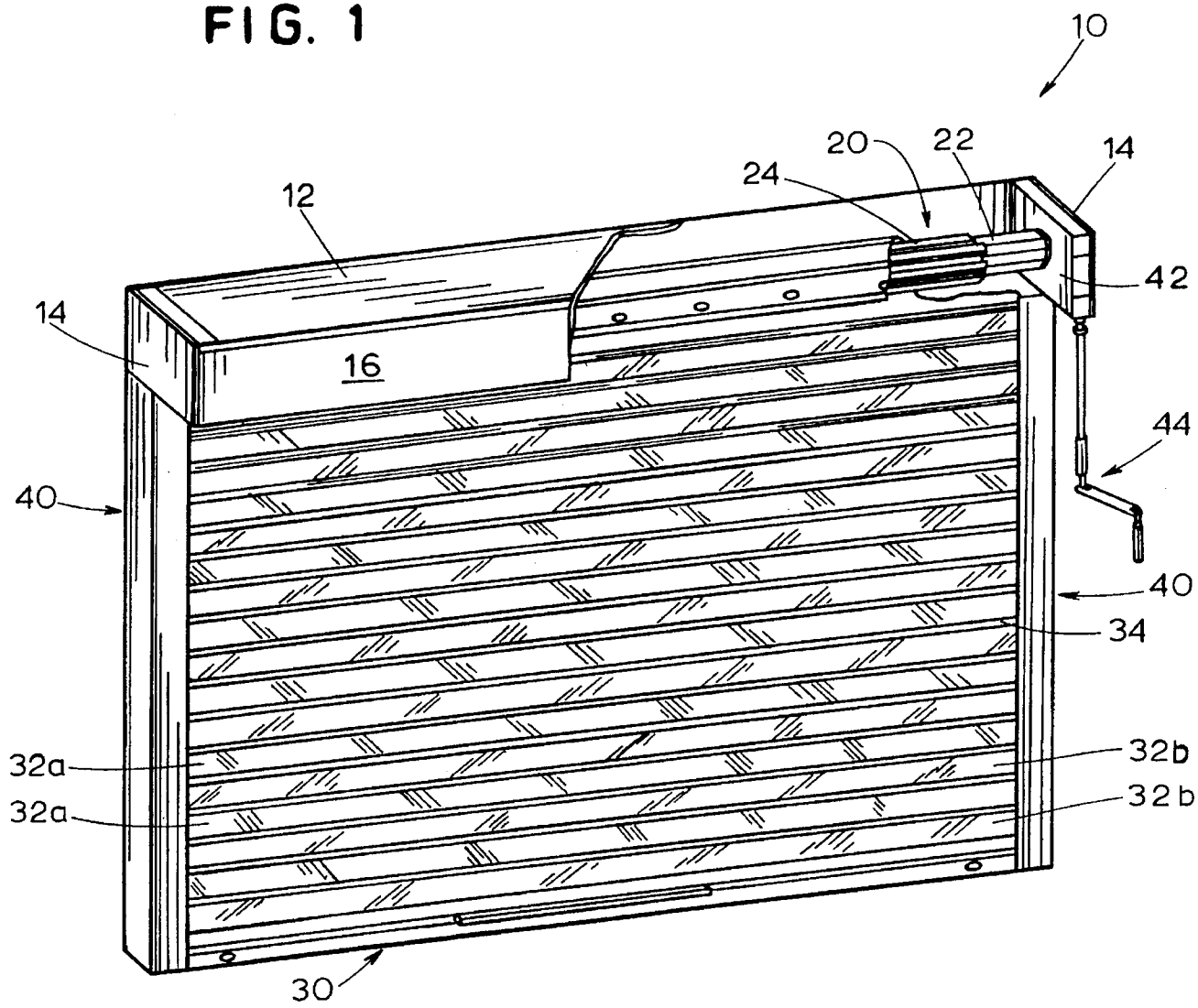
FIG. 1 is a perspective view of a first embodiment of a rolling shutter assembly in accordance with the invention.

A first embodiment of a rolling shutter assembly 10 in accordance with the invention is shown in FIGS. 1–5. Referring to FIG. 1, the shutter assembly 10 has a shutter housing which includes a top wall 12, a pair of side walls 14, and a front wall 16. A shutter support member 20 is mounted for rotation within the shutter housing. The support member 20 includes a generally cylindrical central shaft 22 and a plurality of mounting members 24 fixed to the shaft 22.

The upper end of a rolling shutter 30 is coupled to the mounting members 24. The shutter 30 is composed of a plurality of individual, elongate slats 32. The slats 32, each of which is substantially flat, having two substantially planar side portions, and which may be composed of steel, are interconnected by a plurality of hinges 34, each of which joins together a pair of adjacent slats 32. The slats 32 include a first set of slats **32*a* and a second set of slats 32*b*, the first and second sets of slats being alternated, so that each hinge 34 is connected to one of the slats 32*a* in the first set and one of the slats 32*b*** in the second set.

Figure 2:
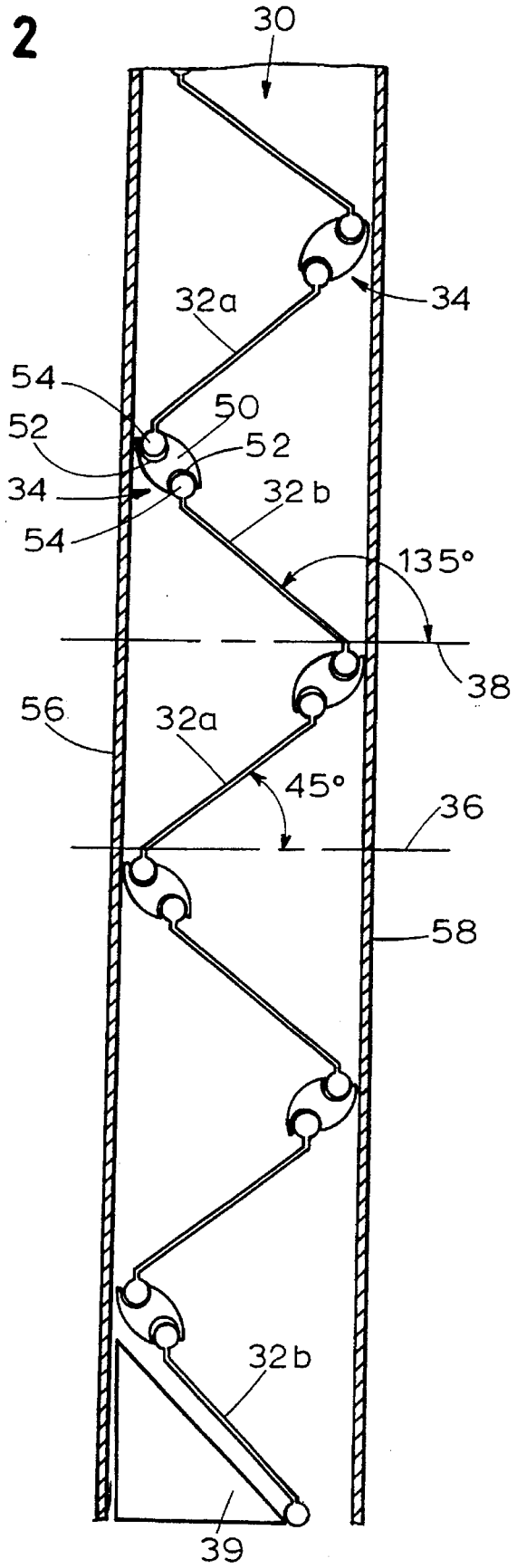
FIG. 2 is a cross-sectional side view of a portion of the shutter assembly of FIG. 1.

When the shutter 30 is in its unrolled position as shown in FIG. 2, the slats **32*a* in the first set occupy a first relative position in which they are aligned with a first angled direction, shown to be about 45° with respect to a horizontal axis 36, and the slats 32*b* in the second set occupy a second relative position in which they are aligned with a second angled direction, shown to be about 135° with respect to a horizontal axis 38. The angular position of the slats 32 could be varied so that the slats 32*a* in the first set occupy an angled direction between about 10° and about 80° with respect to the horizontal and so that the slats 32*b* in the second set occupy an angled direction between about 100° and about 170° with respect to the horizontal. As shown in FIG. 2, an angled member 39 may be provided to facilitate the bottom slat 32*b*** to occupy its angled position.

Referring back to FIG. 1, the ends of the slats 32 are disposed within a pair of shutter tracks 40. The shutter assembly 10 has a gearbox 42 which interconnects the rotatable shaft 22 with a handle 44 via a conventional gear assembly (not shown). When mounted to protect a window, the shutter tracks 40 of the shutter assembly 10 are positioned on either side of the window and the shutter housing is positioned over the top of the window. When the shutter 30 is not in use, it is rolled up on the shutter support member 20 via the handle 44 so that it is at least partially enclosed by the shutter housing. The handle 44 may be disposed on a rear portion of the shutter assembly 10 so that the shutter 30, when attached over a window for example, can be unrolled from inside the window.

Referring to FIG. 2, each of the hinges 34 is composed of an elongate member 50 having a pair of semi-circular sockets 52 formed therein and a pair of circular rods 54 pivotably disposed therein, each of the rods 54 being fixed to one of the slats 32 adjacent the hinge 34. Since the sockets 52 cover slightly over half the diameter of the rods 54, the rods 54 are permanently retained within the sockets 52. When the shutter 30 is in its unrolled position as shown in FIG. 2, each of the hinges 34 makes contact with one side of the shutter tracks 40.

Figure 3:
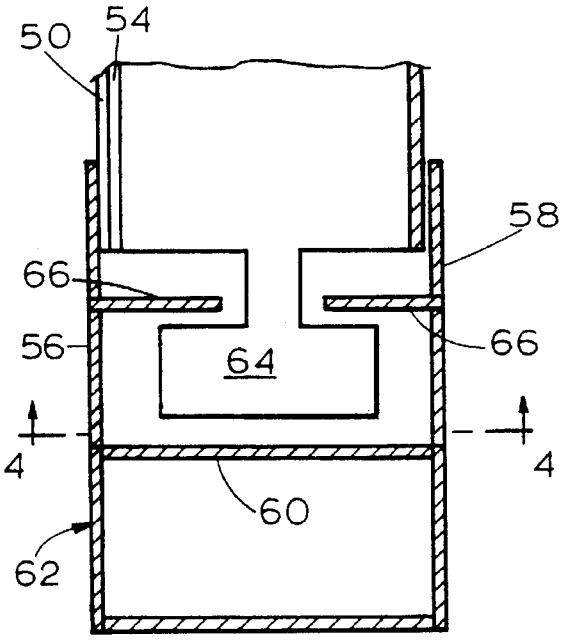
FIG. 3 is a cross-sectional top view of a portion of the shutter assembly of FIG. 1.

The structure of the shutter tracks 40 is illustrated in FIG. 3, which is a horizontal cross-section of one of the shutter tracks 40. Each shutter track 40 is composed of a pair of side walls 56, 58 joined by an end wall 60. A structural support member 62 may be disposed on the outside of the end wall 60 to provide additional structural support to the shutter track 40.

Figure 4:
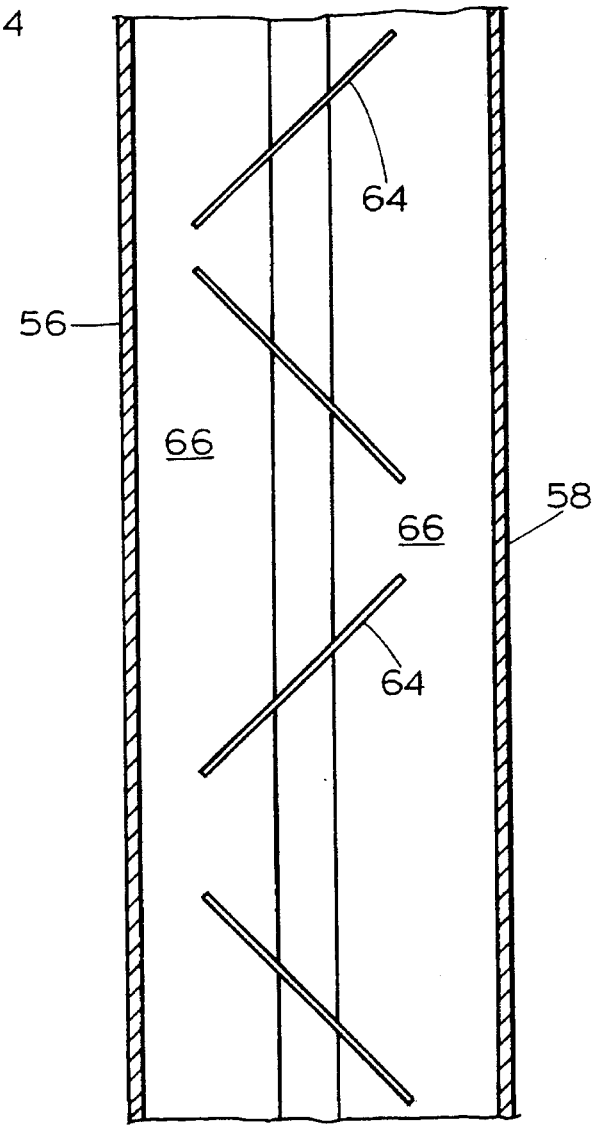
FIG. 4 is cross-sectional side view of a portion of the shutter assembly taken along lines 4—4 of FIG. 3.

As shown in FIGS. 3 and 4, the end of each slat 32 may be provided with a locking member, such as an integral tab 64, which is disposed within a partially enclosed space partly defined by a pair of retaining walls 66 which are spaced apart by a distance less than the width of the tabs 64. When the slats 32 of the shutter 30 are subjected to relatively strong forces, the slats 32 may be deformed until the locking tabs 64 make contact with the retaining walls 66, at which point further deformation of the slats 32 is hindered.

Figure 5:
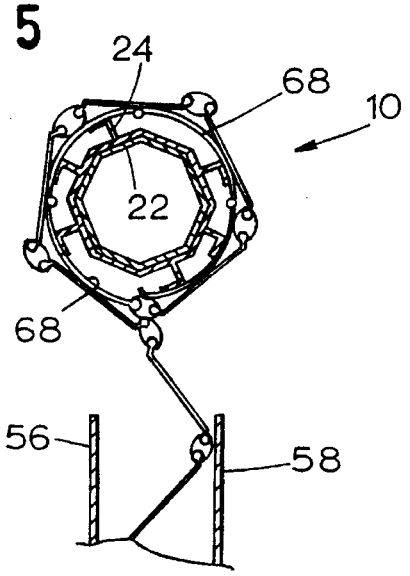
FIG. 5 is a cross-sectional side view of the shutter assembly of FIGS. 1–4 with the shutter shown in a partially rolled up position.

FIG. 5 shows the shutter 30 of the first embodiment partially rolled up. As shown in FIG. 5, the shutter assembly 10 may have a number of curved plates 68 attached to the mounting members 24.

The ability of the shutter 30 to be rolled up while still allowing the slats 32 to occupy their alternating angled positions shown in FIG. 2 is facilitated by the fact that each member 50 allows each attached slat 32 to have a pivot range in excess of about 90° (roughly 120° in the embodiment of FIGS. 1–5). To facilitate the slats 32 to occupy their alternating angled positions, the side walls 56, 58 of the shutter tracks 40 are spaced apart by a distance ranging from about two to about twenty times the maximum thickness of the shutter 30, which in the embodiment of FIGS. 1–5, corresponds to the thickness of the members 50.

Figure 8:
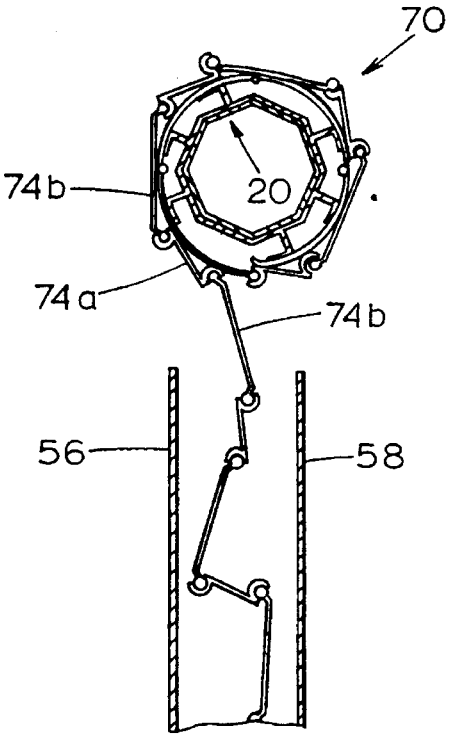
FIG. 8 is a cross-sectional side view of the shutter assembly of FIGS. 6–7 with the shutter shown in a partially rolled up position.
Figure 6:
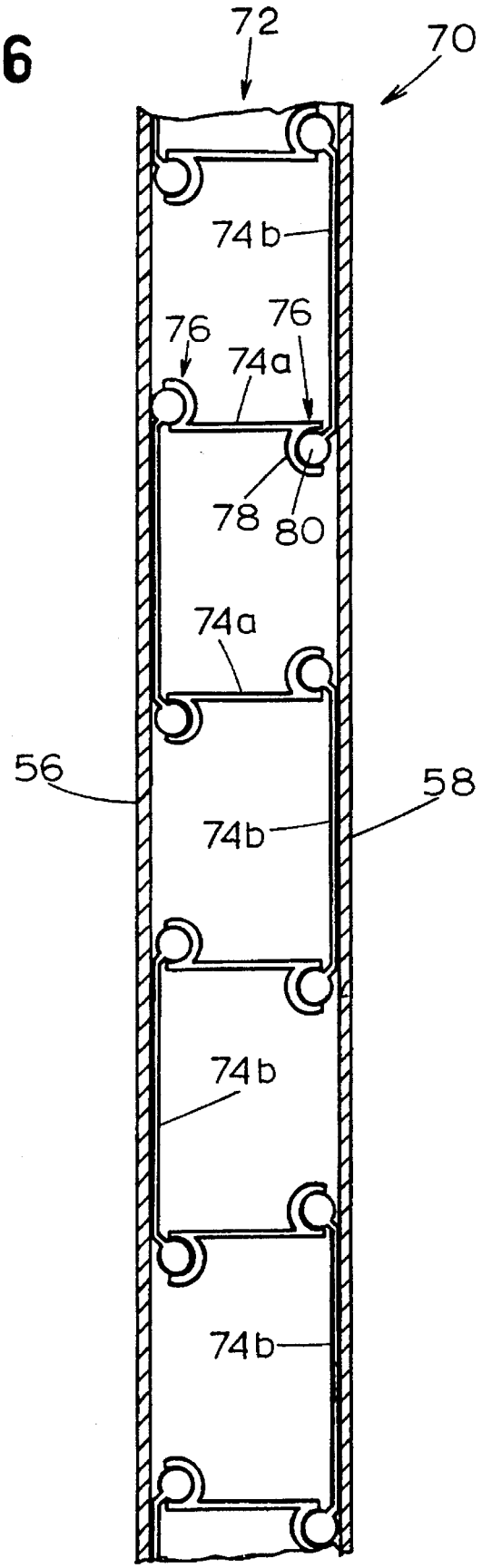
FIG. 6 is a cross-sectional side view of a portion of a second embodiment of a shutter assembly in accordance with the invention.
Figure 7:
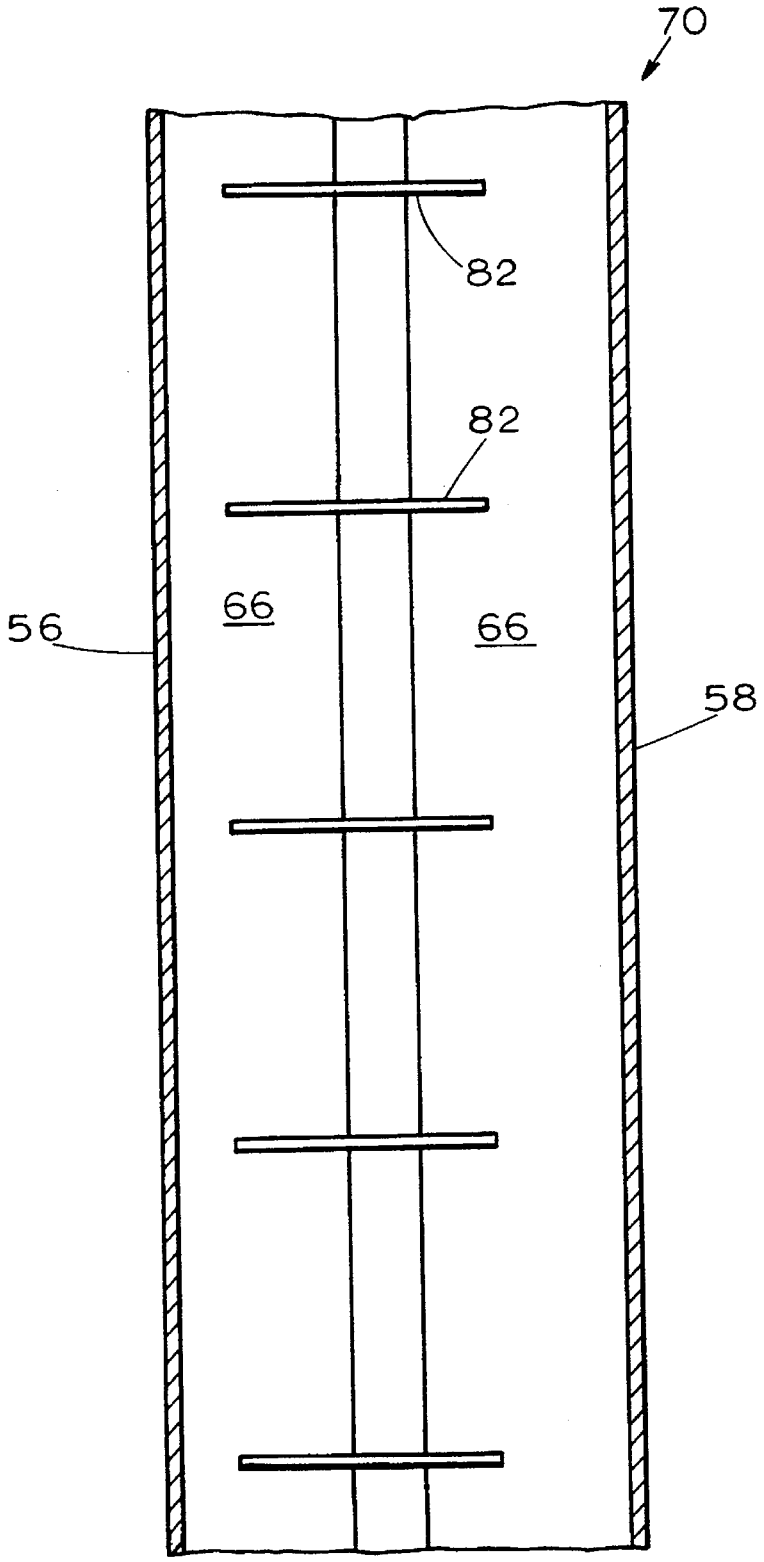
FIG. 7 is a cross-sectional side view of a portion of the shutter assembly of FIG. 6.

A portion of a second embodiment of a shutter assembly 70 is shown in FIGS. 6–8. The shutter assembly 70 has the same components of the shutter assembly 10 of FIG. 1, except that the structure of the shutter is different. The shutter assembly 70 has a shutter 72 which has a first set of slats **74*a* and a second set of slats 74*b* alternated with the first set of slats 74*a*, each of the slats 74*a* in the first set occupying a substantially horizontal position and each of the slats 74*b*** in the second set occupying a substantially vertical position.

The shutter 72 has a plurality of elongate hinges 76, each of which is composed of a semi-circular member 78 with a socket formed therein and a circular rod 80 pivotably disposed in the socket member 78, the rods 80 being integrally formed with the slats 74*a*, 74*b*. Since the socket members 78 cover slightly over half the diameter of the rods 80, the rods 80 are permanently retained within the socket members 78. When the shutter 72 is in its unrolled position as shown in FIG. 6, the vertically disposed slats 74*b* make contact with the sides of the shutter tracks 40.

The ability of the shutter 72 to be rolled up while still allowing the slats 74 to occupy their horizontal and vertical positions shown in FIG. 6 is facilitated by the fact that each socket member 78 allows each attached slat 74 to have a pivot range in excess of about 90° (roughly 120° in the embodiment of FIGS. 6–8). To facilitate the slats 74 to occupy their horizontal and vertical positions, the side walls 56, 58 of the shutter tracks 40 are spaced apart by a distance ranging from about two to about twenty times the maximum thickness of the shutter 72, which in the embodiment of FIGS. 6–8, corresponds to the width of the socket members 78.

As shown in FIG. 7, the ends of the horizontally disposed slats 74*a* of the shutter 72 may have tabs 82 formed integrally therewith, the tabs 82 being disposed within a partially enclosed space partly defined by the retaining walls 66, which are spaced apart by a distance less than the width of the tabs 82 to hinder deformation of the slats 74 when they are subjected to relatively strong forces. FIG. 8 illustrates the shutter 72 partially rolled up on the shutter support member 20.

Figure 9:
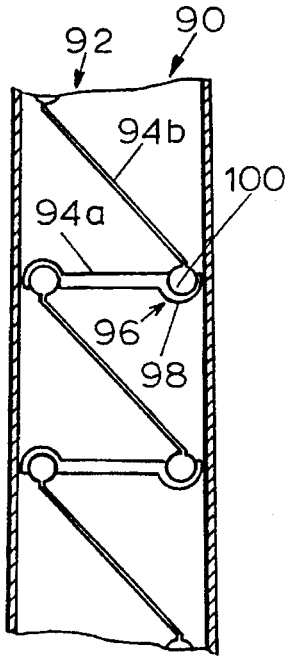
FIG. 9 is a cross-sectional side view of a portion of a third embodiment of a shutter assembly in accordance with the invention.

A portion of a third embodiment of a shutter assembly 90 is shown in FIG. 9. The shutter assembly 90 has the same components of the shutter assembly 10 of FIG. 1, except that the structure of the shutter is different. The shutter assembly 90 has a shutter 92 which has a first set of slats 94*a* and a second set of slats 94*b* alternated with the first set of slats 94*a*, each of the slats 94*a* in the first set occupying a substantially horizontal position and each of the slats 94*b* in the second set occupying an angled position.

The shutter 92 has a plurality of hinges 96, each of which is composed of an elongate, semicircular member 98 with a socket formed therein and an elongate semicircular rod 100 pivotably disposed in the socket member 98, the rods 100 being integrally formed with the slats 94*a*, 94*b*. Since the socket members 98 cover slightly over half the diameter of the rods 100, the rods 100 are permanently retained within the socket members 98.

During the assembly of the protective shutter embodiments described above, the shutters are formed by sliding the elongate rods integrally formed with the slats into the circular recesses of the hinges. After the shutter is assembled in that fashion, it is disposed between the side tracks, which prevent the elongate rods from sliding out of the circular recesses.

Figure 10:
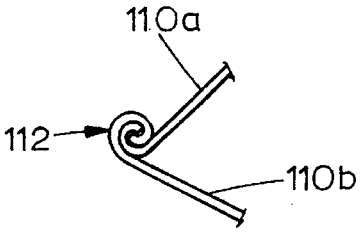
FIG. 10 is a side view of a pair of individual shutter slats pivotally interconnected via an alternative hinge.

Other types of hinges than the ones described above may be utilized to pivotally interconnect the individual slats of the shutter. For example, as shown in FIG. 10, a pair of adjacent shutter slats 110*a*, 110*b* could be pivotally interconnected by a hinge 112 composed of a pair of interlocked curled slat sections. Other types of hinges could be used, such as hinges of the type used in doors or pianos.

Figure 11:
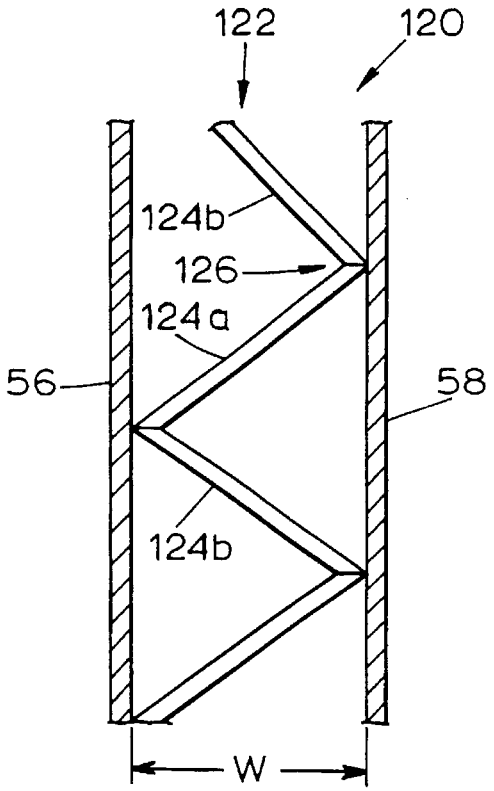
FIG. 11 is a cross-sectional side view of a portion of a fourth embodiment of a shutter assembly in accordance with the invention.
Figure 12:
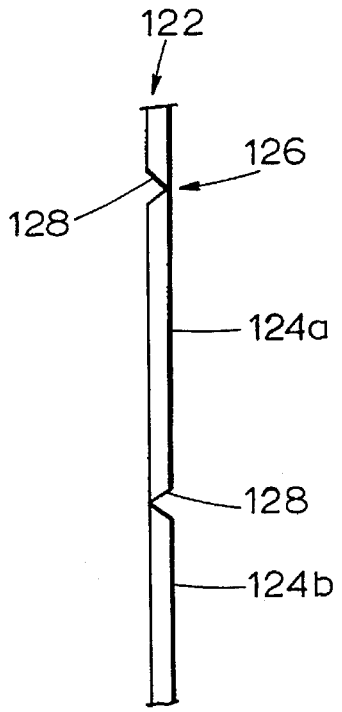
FIG. 12 illustrates a portion of the shutter of FIG. 11.
Figure 13:
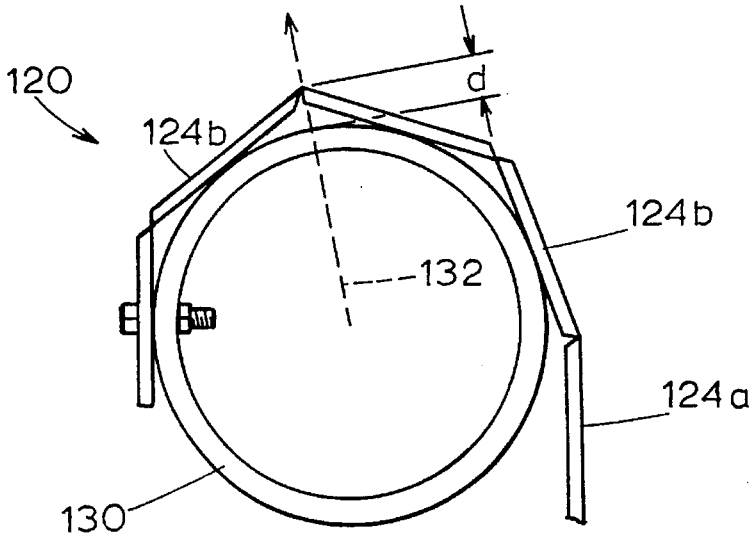
FIG. 13 illustrates a portion of the shutter of FIGS. 11–12 when the shutter is rolled up on a shutter support element.

A portion of a fourth embodiment of a shutter assembly 120 is illustrated in FIGS. 11–13. The shutter assembly 120 has similar components of the shutter assembly 10 of FIG. 1, except that the structure of the shutter is different. The shutter assembly 120 has a shutter 122 with a first set of slats 124*a* and a second set of slats 124*b* alternated with the first set of slats 124*a*, each of the slats 124*a* in the first set occupying an angle between about 10° and about 80° with respect to a horizontal axis and each of the slats in the second set occupying an angle between about 100° and about 170° with respect to the horizontal axis.

The shutter 122, which is formed of a single sheet of material, such as plastic, has a plurality of hinges 126, which are composed of a plurality of elongate V-shaped notches 128 formed in alternating sides of the shutter 122. When the shutter 122 is in its unrolled position as shown in FIG. 11, the slats 124 make contact with the sides 56, 58 of the shutter tracks 40.

The ability of the shutter 122 to be rolled up while still allowing the slats 124 to occupy their angled positions shown in FIG. 11 is facilitated by the fact that the hinges 126 allow the slats 124 to have a pivot range in excess of about 90° (roughly 270° in the embodiment of FIGS. 11–13). To facilitate the slats 124 to occupy their angled positions, the side walls 56, 58 of the shutter tracks 40 are spaced apart by a distance ranging from about two to about twenty times the maximum thickness of the shutter 122.

FIG. 13 illustrates a portion of the shutter assembly 120 with the shutter 122 being partly rolled up on a shutter support element 130. When rolled up, the shutter 122 has a maximum radial thickness d, which is the maximum thickness of a single shutter layer, measured along a ray 132 emanating from the center of the support element 130. It should be noted that the radial shutter thickness tends to decrease the further the shutter 122 is rolled up on the support element 130 since the winding radius (i.e. the radial distance from the center of the support element 130 to the outermost shutter layer) increases as the shutter 122 is rolled up. It should also be noted that the width W of the shutter 122 when unrolled, which is shown in FIG. 11, is substantially greater (at least about twice as great) than the maximum radial thickness of the shutter 122 when rolled up.

Although the slats of the embodiments of the invention described above are substantially flat, they could be provided with a curved shape to facilitate rolling up of the shutter. Other drive mechanisms for rolling the shutter up may also be used. For example, instead of having a hand crank fixed to a gearbox, the drive mechanism may comprise an electric motor directly coupled to the shaft on which the shutter rolls up. Instead of being integrally formed with the shutter slats, the locking tabs described above could be separate tabs connected thereto, such as by bolting or riveting. Instead of tabs, other locking members having different structures could be used.

Other modifications and alternative embodiments of the invention will be apparent to those skilled in the art in view of the foregoing description. This description is to be construed as illustrative only, and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A rolling shutter assembly, comprising:

a shutter support member;

a shutter coupled to said shutter support member, said shutter comprising a plurality of individual slats and a plurality of hinges interconnecting said slats, each of said slats having a pair of slat portions, said slats comprising a first set of slats and a second set of slats, each of said slats in said first and second sets being alternated so that each of said hinges is connected to one of said slats in said first set and one of said slats in said second set;

a pair of shutter tracks;

means for rolling said shutter from an extended position in which said slat portions are disposed in said shutter tracks to a retracted position in which said shutter is rolled up on said shutter support member, said hinges and said shutter tracks being adapted to facilitate, when said shutter is in said extended position, said slats in said first set of slats to occupy a first relative orientation in which said slats are aligned with a first angled direction between about 10° and about 80° with respect to a horizontal axis and said slats in said second set of slats to occupy a second relative orientation in which said slats are aligned with a second angled direction between about 100° and about 170° with respect to said horizontal axis.

2. An assembly as defined in claim 1 wherein said shutter has a maximum thickness and wherein each of said shutter tracks has a pair of side walls between which said slat portions are disposed, said side walls being spaced apart by a distance of at least twice said maximum thickness of said shutter.

3. An assembly as defined in claim 1 wherein each of said hinges comprises a pair of elongate socket portions and a pair of elongate rods, each of said rods being pivotably disposed within one of said socket portions and being integrally connected to one of said slats.

4. An assembly as defined in claim 1 wherein said rolling means comprises a drive assembly for rotating said shutter support member and a handle connected to said drive assembly.

5. An assembly as defined in claim 1 wherein each of said slats is substantially planar.

6. An assembly as defined in claim 1 wherein each of said shutter tracks comprises a pair of side walls and a pair of retaining walls and wherein said slats have end portions with locking members having a width, said retaining walls being spaced apart by a distance less than said width of said locking members so that said locking members are retained in said shutter tracks when said shutter is in said extended position.

7. An assembly as defined in claim 1 additionally comprising a shutter housing which at least partially encloses said shutter when said shutter is in said retracted position.

8. A rolling shutter assembly, comprising:

a shutter support member;

a shutter coupled to said shutter support member, said shutter comprising a plurality of individual slats and a plurality of hinges interconnecting said slats, each of said slats having a pair of slat portions, said slats comprising a first set of slats and a second set of slats, each of said slats in said first and second sets being alternated so that each of said hinges is connected to one of said slats in said first set and one of said slats in said second set;

a pair of shutter tracks;

means for rolling said shutter from an extended position in which said slat portions are disposed in said shutter tracks to a retracted position in which said shutter is rolled up on said shutter support member, said hinges and said shutter tracks being adapted to facilitate, when said shutter is in said extended position, said slats in said first set of slats to occupy a substantially horizontal orientation and said slats in said second set of slats to occupy a substantially vertical orientation.

9. An assembly as defined in claim 8 wherein said shutter has a maximum thickness and wherein each of said shutter tracks has a pair of side walls between which said slat portions are disposed, said side walls being spaced apart by a distance of at least twice said maximum thickness of said shutter.

10. An assembly as defined in claim 8 wherein each of said hinges comprises an elongate socket portion and an elongate rod pivotably disposed within said socket portion and being integrally connected to one of said slats.

11. An assembly as defined in claim 8 wherein said rolling means comprises a drive assembly for rotating said shutter support member.

12. An assembly as defined in claim 8 wherein each of said slats is substantially planar.

13. An assembly as defined in claim 8 wherein each of said shutter tracks comprises a pair of side walls and a pair of retaining walls and wherein said slats have end portions with locking members having a width, said retaining walls being spaced apart by a distance less than said width of said locking members so that said locking members are retained in said shutter tracks when said shutter is in said extended position.

14. An assembly as defined in claim 8 additionally comprising a shutter housing which at least partially encloses said shutter when said shutter is in said retracted position.

15. A rolling shutter assembly, comprising:

a shutter support member;

a shutter coupled to said shutter support member, said shutter comprising a plurality of individual slats and a plurality of hinges interconnecting said slats, each of said slats having a pair of slat portions;

a pair of shutter tracks;

means for rolling said shutter from an extended position in which said slat portions are disposed in said shutter tracks to a retracted position in which said shutter is rolled up on said shutter support member, said hinges and said shutter tracks being adapted to facilitate said slats to occupy different relative orientations when said shutter is in said extended position.

16. An assembly as defined in claim 15 wherein said rolling means comprises a drive assembly for rotating said shutter support member.

17. An assembly as defined in claim 15 wherein each of said slats is substantially planar.

18. An assembly as defined in claim 15 wherein said slats comprise a first set of slats and a second set of slats, each of said slats in said first and second sets being alternated so that each of said hinges is connected to one of said slats in said first set and one of said slats in said second set, and wherein said hinges and said shutter tracks comprise means for facilitating said first set of slats to occupy a first relative orientation when said shutter is in said extended position and said second set of slats to occupy a second relative orientation when said shutter is in said extended position.

19. An assembly as defined in claim 15 wherein said slats comprise a first set of slats and a second set of slats, each of said slats in said first and second sets being alternated so that each of said hinges is connected to one of said slats in said first set and one of said slats in said second set, and wherein said hinges and said shutter tracks comprise means for facilitating said first set of slats to occupy a substantially horizontal position when said shutter is in said extended position and said second set of slats to occupy an angled position aligned with a direction between about 10° and about 170° with respect to a horizontal axis when said shutter is in said extended position.

20. An assembly as defined in claim 15 wherein said shutter has a maximum thickness and wherein each of said shutter tracks has a pair of side walls between which said slat portions are disposed, said side walls being spaced apart by a distance of at least twice said maximum thickness of said shutter.

21. An assembly as defined in claim 15 wherein each of said shutter tracks comprises a pair of side walls and a pair of retaining walls and wherein said slats have end portions with locking members having a width, said retaining walls being spaced apart by a distance less than Said width of said locking members so that said locking members retained in said shutter tracks when said shutter is in said extended position.

22. An assembly as defined in claim 15 additionally comprising a shutter housing which at least partially encloses said shutter when said shutter is in said retracted position.

23. An assembly as defined in claim 15 additionally comprising an angled member for facilitating a lowermost one of said slats to occupy an angled position.

24. A rolling shutter assembly, comprising:

a shutter support member;

a shutter coupled to said shutter support member, said shutter comprising a plurality of slats and a plurality of hinges, each of said slats having a pair of slat portions, a plurality of said slats being formed from a single sheet of material;

a pair of shutter tracks;

means for rolling said shutter from an extended position in which said slat portions are disposed in said shutter tracks to a retracted position in which said shutter is rolled up on said shutter support member, said shutter having a radial thickness when said shutter is rolled up on said shutter support member;

said hinges and said shutter tracks being adapted to facilitate said slats to occupy different relative orientations when said shutter is in said extended position, said slats occupying a width when said shutter is in said extended position, said width being substantially greater than said radial thickness.

25. An assembly as defined in claim 24 wherein each of said hinges comprises a V-shaped slot formed in said sheet of material.

26. An assembly as defined in claim 24 wherein said rolling means comprises a drive assembly for rotating said shutter support member.

27. An assembly as defined in claim 24 wherein each of said slats is substantially planar.

28. An assembly as defined in claim 24 wherein said slats comprise a first set of slats and a second set of slats, each of said slats in said first and second sets being alternated so that each of said hinges is associated with one of said slats in said first set and one of said slats in said second set, and wherein said hinges and said shutter tracks comprise means for facilitating said first set of slats to occupy a first relative orientation when said shutter is in said extended position and said second set of slats to occupy a second relative orientation when said shutter is in said extended position.

* * * * *